United States Patent [19]

Sando et al.

[11] Patent Number: 4,750,275

[45] Date of Patent: Jun. 14, 1988

[54] CYLINDER DRYING MACHINE

[75] Inventors: Yoshikazu Sando; Hiroshi Ishidoshiro, both of Wakayama, Japan

[73] Assignee: Sando Iron Works Co., Ltd.

[21] Appl. No.: 58,042

[22] Filed: Jun. 4, 1987

[30] Foreign Application Priority Data

Jul. 9, 1986 [JP] Japan ..... 61-105461[U]
Jul. 9, 1986 [JP] Japan ..... 61-105462[U]

[51] Int. Cl.[4] ..... F26B 13/08

[52] U.S. Cl. ..... 34/113; 34/114; 34/120; 34/122; 165/89

[58] Field of Search ..... 34/113, 114, 120, 122, 34/124, 117; 165/89

[56] References Cited

U.S. PATENT DOCUMENTS 3,213,858 10/1965 Merritt et al. ..... 34/114
4,124,941 11/1978 Birke et al. ..... 34/114
4,513,517 4/1985 Vedenpaa ..... 34/117

*Primary Examiner*—L. I. Schwartz
*Attorney, Agent, or Firm*—Toren, McGeady & Associates

[57] ABSTRACT

A cylinder drying machine including a plurality of reflecting members arranged in opposition to at least the cloth-contacting surface of each of thermal cylinders, the reflecting members being disposed separately over the cloth-contacting surface of a thermal cylinder so that the distance between the front end portion of each of the reflecting members and the thermal cylinder is shorter than that between the rear end portion thereof and the thermal cylinder with the outer surface of the front end portion of one of two adjacent reflecting members opposed via a clearance to the inner surface of the rear end portion of the other.

2 Claims, 3 Drawing Sheets

CYLINDER DRYING MACHINE

BACKGROUND OF THE INVENTION

1. Field of the Invention

This invention relates to a cylinder drying machine for cloths, which is constructed so that the drying efficiency thereof can be much improved.

An industrially-produced elongated cloth which has been subjected to a treatment step, for example, a pretreatment step, a dyeing step, a mercerization step and a fulling step requires to be sent to a step of washing the cloth, and thereafter to a step of drying the cloth continuously.

2. Description of the Related Art

There is, for example, a cylinder drying machine shown in FIG. 1, as an example of a conventional continuous drying means used for this purpose. As shown in FIG. 1, a cloth 2 to be dried, which has been passed continuously through a plurality of washing tanks 1 and finished being subjected to a desired washing operation, is introduced into a cylinder drying chamber 4, in which a plurality of thermal cylinders 3 are provided, and transferred therethrough as the cloth 2 is brought into contact with the thermal cylinders 3 successively, the dried cloth 2 being then sent out from the drying chamber 4. However, in such a conventional thermal cylinder drying machine, a wet cloth is brought into contact with thermal cylinders 3, which are heated to, for example, 125°-135° C., to gasify the water deposited thereon, and a means for forcibly removing the gasified water occurring around the cloth is not provided. Therefore, the water which has just been removed from the cloth and the vapor which has occurred on the surface of the cloth due to the heat from the thermal cylinders 3 are deposited again thereon, so that a long period of time is required before the drying of the cloth has been completed. When the heating power generated due to the radiation of heat from the circumferential surfaces of the thermal cylinders for heating the cloth is not sufficiently large, it is necessary to provide an increased number of thermal cylinders. Consequently, the dimensions of the drying chamber 4, and the consumption of thermal energy increase. This poses problems of equipment cost, drying cost and drying efficiency.

SUMMARY OF THE INVENTION

The present invention has been developed so as to solve the problems in such a conventional cylinder drying machine. An object of the present invention is to provide a cylinder drying machine capable of removing efficiently from a cloth the gasified water occurring when the cloth contacts the thermal cylinders, and improving the drying efficiency and saving energy by suppressing the radiation of heat from the thermal cylinders.

In order to achieve this object, the present invention provides cylinder drying machines characterized by the construction thereof which will be described below. The characteristics reside in (1) a cylinder drying machine including a plurality of reflecting members arranged in opposition to at least the cloth-contacting surface of each of thermal cylinders, the reflecting members being disposed separately over the cloth-contacting surface of a thermal cylinder so that the distance between the front end portion of each of the reflecting members and the thermal cylinder is shorter than that between the rear end portion thereof and the thermal cylinder with the outer surface of the front end portion of one of two adjacent reflecting members opposed via a clearance to the inner surface of the rear end portion of the other, and (2) a cylinder drying machine including a plurality of reflecting members arranged in opposition to at least the cloth-contacting surface of each of thermal cylinders, the reflecting members being disposed separately above the cloth-contacting surface of a thermal cylinder so that the distance between the front end portion of each of the reflecting members and the thermal cylinder is shorter than that between the rear end portion thereof and the thermal cylinder with an air-sucking and discharging clearance provided between two adjacent reflecting members.

The above and other objects as well as advantageous features of the invention will become apparent from the following description of the preferred embodiments taken in conjunction with the accompanying drawings.

DETAILED DESCRIPTION OF THE PREFERRED EMBODIMENTS

The preferred embodiments of the present invention will now be described with reference to FIGS. 2–5.

EXAMPLE 1

Figure 1:
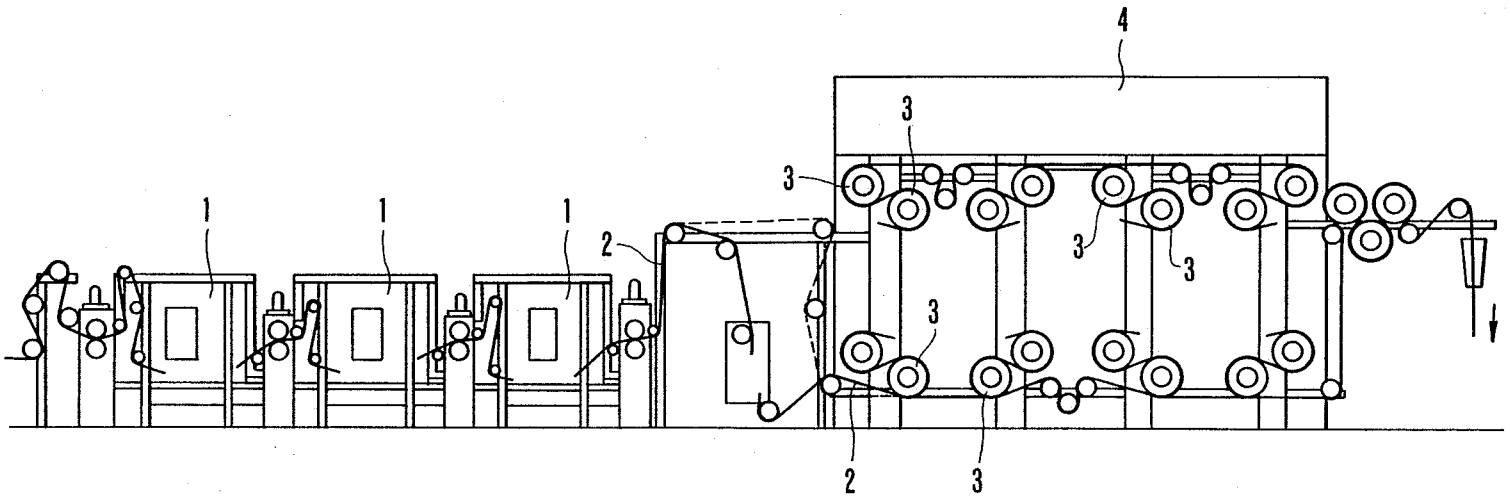
FIG. 1 illustrates a conventional cylinder drying machine as a whole, which is used to treat a cloth continuously.
Figure 2:
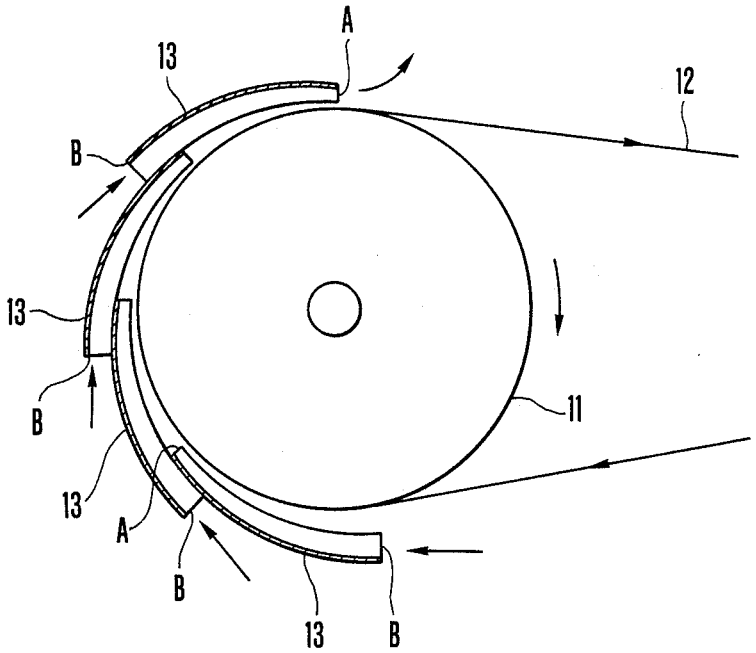
FIG. 2 is a side elevation of a principal portion of an embodiment of the cylinder drying machine according to the present invention.
Figure 3:
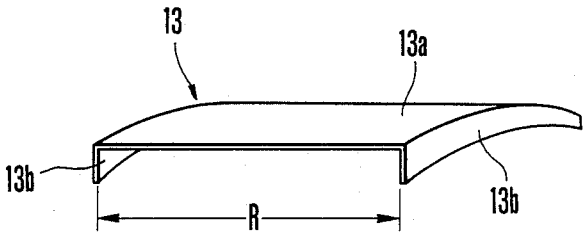
FIG. 3 is a perspective view of a member of the embodiment.

FIGS. 2 and 3 show a first embodiment of the present invention. Referring to these drawings, reference numeral 11 denotes a thermal cylinder, a plurality of thermal cylinders 11 being provided in a drying chamber 4 in the same manner as shown in the drawing of a conventional example of the machine of this kind. A water-containing cloth 12 to be dried is transferred as it is engaged with and guided by the thermal cylinders 11. The cloth 12 receives the thermal power from the thermal cylinders 11 and is dried gradually. In this embodiment, a plurality of reflecting members 13 are provided in opposition to the cloth-contacting surface of each thermal cylinder 11 so that the reflecting members 13 are spaced from the outer surface of the thermal cylinder 11 and arranged in the rotational direction thereof. Each of these reflecting members 13 consists of a curved portion 13*a* having substantially the same radius of curvature as the circumferential surface of the thermal cylinder 11, and side wall portions 13*b* formed at both side edges of the curved portion 13*a*, as shown in FIG. 3. The distance R between the two side wall portions 13*b* is set slightly longer than the axial length of the thermal cylinder 11. These reflecting members (four reflecting members in this embodiment) 13 are arranged above the cloth-contacting surface of the thermal cylinder 11 as shown in FIG. 1. Namely, the reflecting members are arranged so that the front end portions A thereof face in the rotational direction of the thermal cylinder 11, and also in such a manner that the distance between the front end portion A of each reflecting member 13 and the thermal cylinder 11 is shorter than that between the rear end portion B thereof and the thermal cylinder 11 with the front end portion A of one of two adjacent reflecting members 13 positioned via a clearance on the inner side of the rear end portion B of the other.

In this embodiment, the reflecting members 13 are arranged as they are spaced slightly from at least the cloth-contacting surface of each thermal cylinder 11. Accordingly, the heat radiated from the circumferential surface of the thermal cylinder 11 to pass through the cloth 12 is reflected on the reflecting member 13 to be applied to the outer surface of the cloth 12, so that the heat can be effectively utilized. This enables the thermal energy to be saved, and the drying rate to be improved. Since a plurality of reflecting members 13 are arranged separately so that the distance between the front end portion A of each reflecting member and the thermal cylinder 11 is shorter than that between the rear end portion B thereof and the thermal cylinder 11 with the front end portion A of one of two adjacent reflecting members 13 positioned via a clearance on the inner side of the rear end portion B of the other. Therefore, air currents occur due to the rotation of the thermal cylinder 11 between these reflecting members 13 and the thermal cylinder 11, and the vapor heat (gasification heat) occurring on the cloth 12 is discharged effectively from the front end portion A of the foremost reflecting member 13 by these air currents. During this time, the outside air of a low humidity is sucked from the clearances provided between the front end portions A of the reflecting members 13 and the rear end portions B thereof. Accordingly, the air of a high humidity can be replaced by the air of a low humidity very effectively. This also serves to enable the drying of the cloth to be done very effectively and continuously.

In this embodiment, the heat radiated from the circumferential surface of a thermal cylinder and passing through the cloth to be dried is reflected on the reflecting members and applied to the outer surface of the cloth, so that the heat can be effectively utilized. In the clearance between these reflecting members and thermal cylinder, air currents occur due to the rotation of the thermal cylinder, whereby the vapor heat (gasification heat) occurring on the cloth 12 is discharged effectively from the front end portion of the foremost reflecting member. During this time, the outside air of a low humidity is sucked from the clearances provided between the front and rear end portions of the reflecting members, so that the air of a high humidity can be replaced effectively with the air of a low humidity. Accordingly, the drying of a cloth can be done effectively and continuously in a short period of time in a thermal energy-saving arrangement.

EXAMPLE 2

Figure 4:
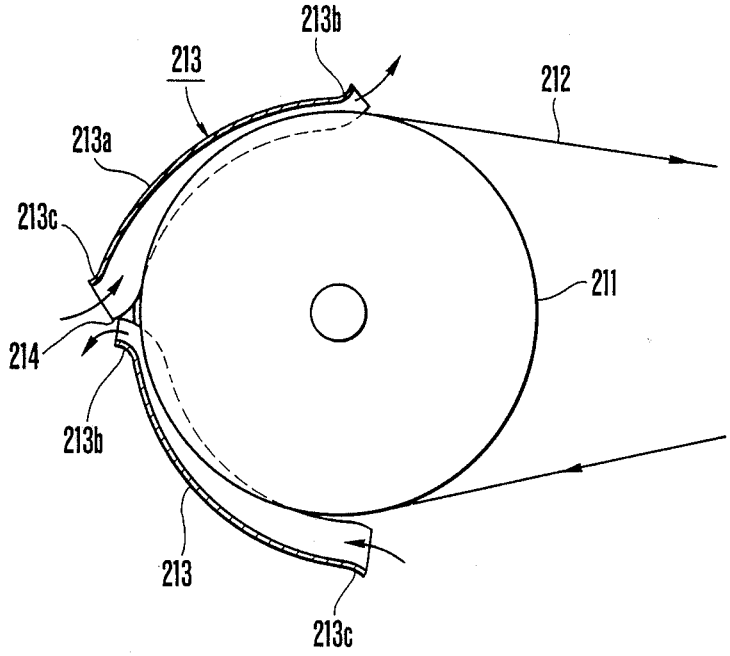
FIG. 4 is a side elevation of a principal portion of another embodiment of the present invention.
Figure 5:
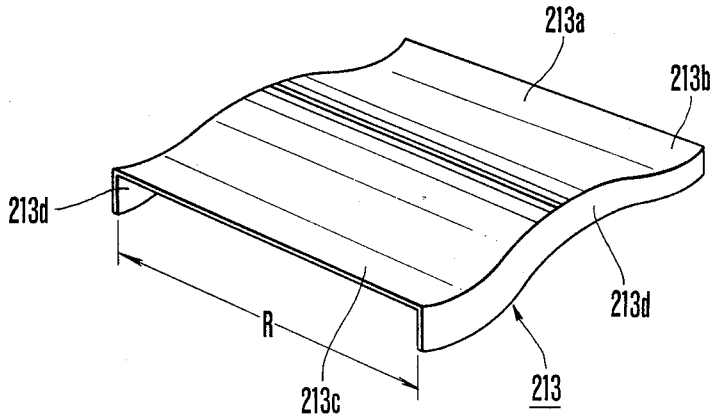
FIG. 5 is a perspective view of a member of the embodiment of FIG. 4.

FIGS. 4 and 5 show a second embodiment of the present invention. Referring to the drawings, reference numeral 211 denotes a thermal cylinder. A plurality of thermal cylinders 211 are arranged in a drying chamber 4 in the same manner as in the conventional drying machine of FIG. 1. A water-containing cloth 212 to be dried is transferred as it is engaged with and guided by these thermal cylinders 211, and it receives the thermal power from the thermal cylinders 211 to be gradually dried. In this embodiment, a plurality of reflecting members 213 are provided in opposition to and separately from the cloth-contacting surface of each thermal cylinder 211 so that the reflecting members extend in the rotational direction of the thermal cylinder 211. As shown in FIG. 5, each reflecting member 213 consists of a curved portion **213*a* having a radius of curvature substantially equal to that of the circumferential surface of the thermal cylinder 211, warped portions 213*b*, 213*c* formed at the front and rear end sections of the curved portion 213*a* and curved in the direction opposite to the direction in which the curved portion 213*a* extends, and side wall portions 213*d* formed at both side edges of the curved portion 213*a*. The distance R between these side wall portions 213*d* is set slightly longer than the axial length of the thermal cylinder 211. The reflecting members 213 are arranged as shown in FIG. 4, i.e., in such a manner that the front warped portion 213*b* of each thereof faces in the rotational direction of the thermal cylinder 211 with a clearance between the front warped portion 213*b* and thermal cylinder 211 set narrower than that between the rear warped portion 213*c* and thermal cylinder 211. The rear end of one reflecting member 213 and the front end of the other are spaced suitably, and a gas guide member 214 is provided in the clearance between these opposed ends of the reflecting members 213 that the discharging of the gas between the thermal cylinder 211 and reflecting members 213** and the sucking of the outside air into the space therebetween can be done smoothly.

In this embodiment, a plurality of reflecting members 213 are arranged over at least the cloth-contacting surface of a thermal cylinder 211 so as to extend in the circumferential direction of the thermal cylinder 211. Accordingly, the heat radiated from the circumferential surface of the thermal cylinder 211 being heated, to pass through the cloth 212 is reflected on the reflecting members 213 and applied to the outer surface of the cloth 212. Consequently, the thermal energy can be saved, and the drying rate can be improved. Since these reflecting members 213 are so arranged that the adjacent reflecting members are spaced from each other, the vapor heat (gasified water) is discharged effectively from the front end portions **213*b* of the reflecting members 213 while the thermal cylinder 211 is rotated. During this time, the outside air of a comparatively low humidity is sucked into the clearances between the reflecting members 213 and thermal cylinder 211**, so that the air of a high humidity can be replaced effectively by the air of a low humidity. Thus, the drying of the cloth can be done very effectively and continuously.

In this embodiment, the same effect as in Embodiment 1 can be obtained. Moreover, since the outside air of a low humidity is sucked from the rear end portions of the reflecting members into the clearances between the reflecting members and thermal cylinder, the air of a high humidity can be replaced very effectively and continuously in a short period of time in a thermal energy-saving arrangement.

The present invention is not, of course, limited to the above embodiments; it may be modified in various ways within the scope of the appended claims.

What is claimed is:

1. A cylinder drying machine comprising a plurality of reflecting members arranged in opposition to at least the cloth-contacting surface of each of a plurality of thermal cylinders, said reflecting members being disposed separately over the cloth-contacting surface of the relative thermal cylinder so that the distance between the front end portion of each of said reflecting members and said thermal cylinder is shorter than that between the rear end portion thereof and said thermal cylinder with the outer surface of the front end portion of one of two adjacent reflecting members opposed via a clearance to the inner surface of the rear end portion of the other.

2. A cylinder drying machine comprising a plurality of reflecting members arranged in opposition to at least the cloth-contacting surface of each of a plurality of thermal cylinders, said reflecting members being disposed separately over the cloth-contacting surface of the relative thermal cylinder so that the distance between the front end portion of each of said reflecting members and said thermal cylinder is shorter than that between the rear end portion thereof and said thermal cylinder with an air-sucking and discharging clearance provided between two adjacent reflecting members.

* * * * *